US007861490B2

(12) United States Patent
Hartness et al.

(10) Patent No.: US 7,861,490 B2
(45) Date of Patent: Jan. 4, 2011

(54) METHOD OF PACKAGING ARTICLES

(75) Inventors: Thomas P. Hartness, Greenville, SC (US); William R. Hartness, III, Greenville, SC (US); Mark W. Davidson, Greer, SC (US); Ernst Van Wickeren, Weeze (DE)

(73) Assignee: Illinois Tool Works Inc., Glenview, IL (US)

( * ) Notice: Subject to any disclaimer, the term of this patent is extended or adjusted under 35 U.S.C. 154(b) by 897 days.

(21) Appl. No.: 11/588,844

(22) Filed: Oct. 27, 2006

(65) Prior Publication Data

US 2007/0215506 A1 Sep. 20, 2007

Related U.S. Application Data

(63) Continuation-in-part of application No. 11/384,031, filed on Mar. 17, 2006.

(51) Int. Cl.
*B65B 53/02* (2006.01)

(52) U.S. Cl. ..... 53/48.2; 53/442; 53/443; 53/557

(58) Field of Classification Search ..... 53/441–443, 53/48.2, 509, 523, 526, 127, 140, 556–557
See application file for complete search history.

(56) References Cited

U.S. PATENT DOCUMENTS 2,575,580 A 11/1951 Cadmus
3,112,826 A 12/1963 Blum
3,123,955 A * 3/1964 Weissensee et al. ..... 53/442
3,513,970 A 5/1970 Eckholm, Jr.
3,599,388 A * 8/1971 Feingold ..... 53/455
3,621,628 A 11/1971 Chidsey, Jr.
3,759,378 A 9/1973 Werth (Continued)

FOREIGN PATENT DOCUMENTS

EP 0395370 A1 10/1990

(Continued)

OTHER PUBLICATIONS

International Search Report for PCT/US2007/082797 mailed May 2, 2008—4 pages.

(Continued)

*Primary Examiner*—Christopher Harmon
(74) *Attorney, Agent, or Firm*—Dority & Manning, P.A.

(57) ABSTRACT

A heat-shrinkable holder is disclosed for securing a plurality of articles. The holder may include a first sheet formed of heat-shrinkable material, and a second sheet formed of heat-shrinkable material and joined to the first sheet. The first sheet and the second sheet each have a substantially equal pre-shrinking length, and are joined so as to create at least two openings therebetween. Each of the openings is sized larger than one of the articles. The first and second sheets are heat-shrinkable to an extent to shrink the openings sufficiently to secure two of the articles together into a unit. Various modifications and additions are possible, including use of more than three sheets, providing for the reading of printed indicia on the articles or holder, providing a handle. Numerous orientations and collections of articles are possible. Related packages including a holder and articles are also disclosed, as well as related methods of manufacture of the holder and package.

12 Claims, 10 Drawing Sheets

U.S. PATENT DOCUMENTS 4,175,994 A * 11/1979 Norton et al. ..... 156/251
4,377,234 A 3/1983 Kaplan
4,392,056 A 7/1983 Weyandt
4,412,876 A 11/1983 Lerner et al.
4,467,207 A 8/1984 Lerner et al.
4,565,592 A 1/1986 Wehrmann et al.
4,620,888 A 11/1986 Easter et al.
4,680,205 A 7/1987 Lerner et al.
4,926,048 A 5/1990 Lerner et al.
4,944,825 A 7/1990 Gifford et al.
4,945,252 A 7/1990 Lerner et al.
5,059,114 A 10/1991 Stout et al.
5,177,931 A * 1/1993 Latter ..... 53/133.3
5,232,541 A 8/1993 Gifford
5,300,161 A 4/1994 Gifford
5,317,794 A 6/1994 Lerner et al.
5,373,618 A 12/1994 Doyle et al.
5,411,627 A 5/1995 Lerner et al.
5,433,057 A 7/1995 Lerner et al.
5,441,678 A 8/1995 Liebhart
5,442,851 A 8/1995 Lerner et al.
5,477,956 A 12/1995 Liebhart
5,483,783 A 1/1996 Lerner et al.
5,669,112 A 9/1997 Huang
5,685,053 A 11/1997 Deonarine et al.
5,697,489 A 12/1997 Deonarine et al.
5,766,390 A 6/1998 Jensen
5,820,714 A 10/1998 Lerner
5,941,052 A * 8/1999 Evangelisti ..... 53/433
6,145,656 A 11/2000 Marco
6,170,237 B1 * 1/2001 Wipf ..... 53/455
6,213,293 B1 4/2001 Marco
6,415,917 B1 7/2002 Marco
6,470,652 B1 * 10/2002 Piron ..... 53/511
6,564,530 B2 5/2003 Marco
6,935,491 B2 8/2005 Marco
7,021,036 B2 * 4/2006 Hiramoto et al. ..... 53/562
7,048,817 B1 5/2006 Hammond
7,155,876 B2 * 1/2007 VanderTuin et al. ..... 53/557
2007/0215503 A1 9/2007 Hartness et al.
2008/0272013 A1 11/2008 Hartness et al.

FOREIGN PATENT DOCUMENTS

FR 2637866 A1 4/1990
FR 2733733 A1 11/1996
FR 2 831 094 A 4/2003
FR 2832985 A1 6/2003
WO WO 96/33924 10/1996
WO WO 97/21608 6/1997
WO WO 02/29768 4/2002
WO WO 2005/021405 3/2005
WO WO 2008/052211 5/2008

OTHER PUBLICATIONS

Abstract of FR 2637866, published Apr. 20, 1990.
Abstract of FR 2733733, published Nov. 8, 1996.
Abstract of FR 2832985, published Jun. 6, 2003.
International Search Report from PCT/US2009/046240—8 pages.

* cited by examiner

METHOD OF PACKAGING ARTICLES

CROSS REFERENCE TO RELATED APPLICATIONS

The present application claims priority to and is a continuation-in-part application of application Ser. No. 11/384,031, filed on Mar. 17, 2006, and which is incorporated herein by reference in its entirety.

FIELD OF THE INVENTION

The present invention relates generally to a heat-shrinkable holder for securing articles, a package securing such articles using heat-shrinkable sheets, and a method of securing such articles using heat-shrinkable sheets.

BACKGROUND OF THE INVENTION

Articles such as beverage containers are often secured together using thermoplastic ring-type carriers. Some such carriers are sometimes known as "six-pack" carriers, although carriers for holding various numbers of containers have been used. Typically, such carriers comprise a flexible plastic, for example made from a low-density polyethylene. The carriers have openings formed smaller than the containers. The carriers are stretched over a suitably positioned group of the containers. When released, the openings conform to the sides of the containers, thereby unitizing the containers into a package.

The characteristics of the plastics used in such stretch-loaded carriers are such that it can be difficult to remove individual containers or groups of containers together due he the amount of force required. In particular, the complexity of manufacture and use of such carriers increases substantially with the number of containers being held by the carrier. Also, the carriers used are generally small strips, located around the top portion of the containers, for example along a ridge at the top of a can. The plastics are thus not susceptible to carrying printed indicia, and are typically not sufficiently transparent or translucent so as to allow the view of any indicia on the containers being held. Also, a fair amount of force and complicated machinery is required to stretch the carriers so as to place them over the containers. Therefore, although stretch-loaded carriers have been used for many years, various drawbacks do exist with regard to stretch-loaded carriers.

In conventional shrink-wrapping, a load is fed to a wrapping zone in which a shrink-wrap film is placed on the load in some fashion. The film is cut into pieces or sheets before or during the placement on the load. Typically, the film makes a complete revolution around the load so that two cut ends overlap. The load and film are then passed into a heating tunnel causing the film to shrink and compress against the load. Typically, the film is cut into sheets large enough to allow for some overlap between edges when placed on the load. During the heating process, the edges may therefore be sealed together forming a unitary package.

Groups of articles such as containers have been wrapped with shrink-wrap in such fashion previously. However, due to the nature of conventional shrink-wrapping, the film extends only around the outside of the articles. Therefore, individual articles may not be removed without compromising the integrity of the entire package, and individual articles may contact each other while packaged, possibly leading to damage. To address issues such as thee, sometimes, articles are even placed in a first container such as a box or a stretch wrap carrier, and then shrink-wrapped. Such packaging adds cost and wastes material.

Accordingly, an improved holder for articles such as containers, an improved package of unitized containers, and improved methods of packaging would be welcome, addressing one or more of the above drawbacks of conventional packaging technology, and/or other disadvantages of currently available technology.

SUMMARY OF THE INVENTION

According to certain aspects of the invention, a heat-shrinkable holder is disclosed for securing a plurality of articles, the holder including a first sheet formed of heat-shrinkable material and having a pre-shrinking length, and a second sheet formed of heat-shrinkable material substantially equal to the first sheet pre-shrinking length, the second sheet being joined to the first sheet. The first sheet and the second sheet are joined so as to create at least two openings therebetween, each of the openings sized larger than one of the articles, the first and second sheets being heat-shrinkable to an extent to shrink the openings sufficiently to secure two of the articles together into a unit. Various options and modifications are possible.

For example, the holder may include two of the first sheets and two of the second sheets joined together in a unit, and the holder may be configured with a plurality of openings arranged in to rows and/or with six openings for securing six articles in a two-by-three arrangement.

The articles may be arranged so that they do not contact each other directly when secured. At least one of the first or second sheets may include printed indicia relating to the article. The first and second sheets are may be joined via at least one of heating or an adhesive. The openings may have an internal circumference larger than an outer circumference of the article to be placed therein. The holder may be formed in a group of separable holders formed sequentially from the first and second sheets, and perforations may be provided for separating adjacent holders formed from the first and second sheets. The holder may further include a handle extending from at least one of the first and second sheets, and the articles may be containers. At least one of the first or second sheets may include perforations configured for allowing an article to be removed from the unit after heat shrinking.

According to other aspects of the invention, a package of articles is disclosed including a plurality of articles, a first sheet formed of heat-shrinkable material and having a pre-shrinking length, and a second sheet formed of heat-shrinkable material substantially equal to the first sheet pre-shrinking length, the second sheet being joined to the first sheet. The first sheet and the second sheet are joined so as to create at least two openings therebetween, each of the openings sized larger than one of the articles, the first and second sheets being heat-shrinkable to an extent to shrink the openings sufficiently to secure two of the articles together into a unit. As above, various options and modifications are possible.

According to other aspects of the invention, a package of articles is disclosed including a plurality of articles, and at least four sheets of heat-shrunken material having substantially equal pre-shrinking lengths, the sheets being joined at a plurality of discrete joinder portions thereby forming a plurality of openings arranged in at least two rows, each opening sized to secure an article therein, the heat-shrunken material and articles thereby forming a unitary heat-shrunken package configured with a plurality of articles arranged in at least two rows. As above various options and modifications are possible.

For example, the package may be configured so that the articles are drawn together in two perpendicular directions by the shrinking, and/or with the openings arranged in a two-by-four arrangement or a two-by-three arrangement. The package may be configured so that articles do not contact each other directly when secured.

According to certain other aspects of the invention, a heat-shrinkable holder is disclosed for securing a plurality of articles, the holder including at least four sheets of heat-shrunken material having substantially equal pre-shrinking lengths, the sheets being joined at a plurality of discrete joinder portions thereby forming a plurality of openings arranged in at least two rows, each of the openings sized larger than one of the articles, the sheets being heat-shrinkable to an extent to shrink the openings sufficiently to secure two of the articles together into a unit having at least two rows of articles. Again, various options and modifications are possible.

According to other aspects of the invention, a method of packaging articles is disclosed including providing a first sheet of heat-shrinkable material, the first sheet defining a plurality of pre-shrinking holder lengths; providing a second sheet of heat-shrinkable material, the second sheet defining a plurality of pre-shrinking holder lengths substantially equal to those of the first sheet; joining the first sheet to the second sheet at discrete joinder portions spaced along the first and second sheet so as to form a plurality of openings, each opening located between each adjacent pair of joinder portions, the joinder forming a plurality of holders each having the pre-shrinking holder lengths of the first and second sheets; inserting an article into each of the openings; and heating the first and second sheets to shrink the first and second sheets thereby forming a unitary package of the sheets and the inserted articles. Various options and modifications are possible with this method as well.

For example, the method may further include cutting the first and second sheets to form an article holder of the pre-shrinking holder length before the heating step. Also, the method may further include providing two of the first and second sheets of heat-shrinkable material. The method may involve joining the first and second sheets so as to form a plurality of openings arranged in two rows. Also, the method may include forming perforations in at least one of the first or second sheets to allow removal of individual articles. The joining step may be achieved by at least one of applying an adhesive or applying heat. The method may further include opening the openings before the inserting step. The opening step may include one of blowing a gas, applying suction, or using one or more mechanical fingers to open the openings. The articles may be containers, and the first and second sheets are sized so that during the heating step the articles are drawn together in two perpendicular directions. The method may include providing a handle for the package.

DETAILED DESCRIPTION OF THE PREFERRED EMBODIMENTS

Figure 1A:
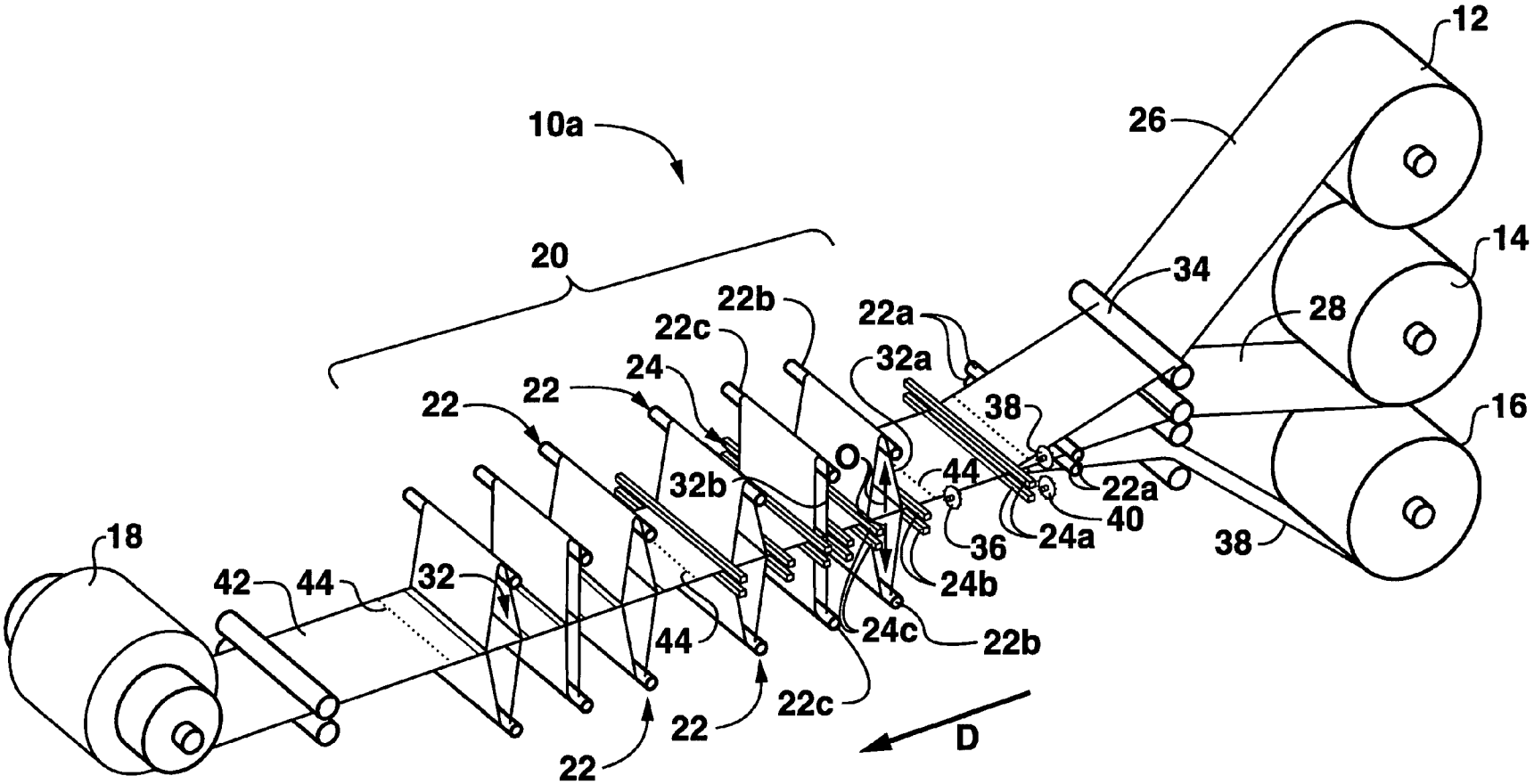
FIG. 1A is a perspective schematic view of one possible line configuration of a line for manufacturing heat-shrinkable holders according to certain aspects of the present disclosure.

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations. In discussing various embodiments, like or similar reference numerals are used below with like or similar parts of various embodiments.

As described herein, a shrink-wrapping material may be used to form holder for articles. Preferably, the holder is formed from at least two sheets of the heat shrinkable material for holding at least one row of articles. However, more sheets and various configurations could be employed. For example, three sheets could be used for two rows of articles, as in a conventional six-pack (two by three) arrangement. If desired the sheets may have different properties, and all sheets need not be heat-shrinkable. For example, one of two sheets may be heat shrinkable, or two of three sheets may be heat shrinkable, as discussed below. The non-shrinkable sheets may be provided for structural stability (for example, use as a center sheet or a handle), for carrying printed indicia, or for other purposes. The present disclosure also includes various packages for holding articles, and methods for creating such holders and packages.

FIGS. 1A through 3 disclose one possible method for manufacturing such holders and creating such packages. The example used therein is for a conventional six-pack of cans. It should be understood also that the present invention has utility with various articles, not just containers, and with various containers, not just cans, as shown.

Figure 2A:
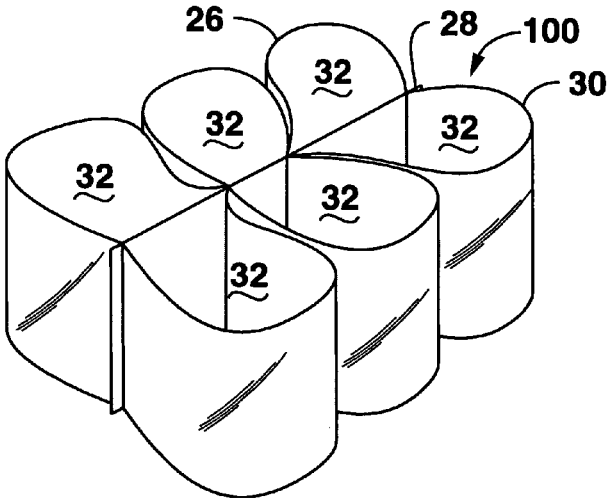
FIG. 2A is a perspective view of one example of an empty heat shrinkable holder.

More particularly, FIG. 1A is a perspective schematic view of one possible line configuration of a line for manufacturing heat-shrinkable holders, an example of which is shown in FIG. 2A. As shown in FIG. 1A, line 10*a* includes film supply rolls 12, 14, 16 at one end and take up roll 18 at the other. Between the rolls lies a forming zone 20, where film from rolls 12, 14, 16 is formed into holders for articles.

Forming zone 20 includes spreaders 22 and sealers 24. As shown in FIG. 1A, spreaders 22 are rods inserted between films 26, 28, 30 to create openings 32. At the rightmost end of forming zone 20, spreaders 22*a* are being inserted between the films 26, 28, 30, closely adjacent to film 28. Spreaders 22 generally travel along direction D with the films once inserted. By the time spreaders 22*a* move along direction D and reach the position of spreaders 22*b*, spreaders 22*a* will have moved outward from film 28 in the directions of arrows O. Simultaneously sealers 24 are sealing films 26 and 30 to film 28. As illustrated, sealers 24 are heat-sealing devices, although other devices could be used to seal the films together, such as adhesive applying devices. Sealers 24*a* hold and seal the films 26, 28, 30 together thereby forming joinder portions while spreader 22*a* moves to the position of spreader 22*b*. Then, another sealer 24 (not shown) will contact films 26, 28, 30 and seal them together to create another opening (not shown) upstream from opening 32*a*.

As shown, each opening 32 is formed by one spreader 22 and two sealers 24. It is also possible to form adjacent openings utilizing common sealers 24 between them. Therefore, only one sealer set 24 could be provided above and below the films between openings 32*a* and 32*b*, for example. Such sealer set could make a single point contact, thereby changing the shapes of the openings a bit to widen them, or could extend along direction D between openings 32*a* and 32*b* and seal the entire area between sealers 24*b* and 24*c*. All openings 32 need not be the same size. For example, the outermost openings may be larger than the center opening in a common six pack arrangement (not different sizes of openings being formed in FIG. 1A). Thus, the loops of film 26 may have different sizes along a given holder. Making the central loops smaller may help pull the resulting package together more tightly during heat-shrinking.

Spreaders 22 and sealers 24 should remain in contact with films 26, 28, 20 long enough to reliably seal them together to form a blank 42. The amount of contact time may vary according to line speed, sealer type (heat versus adhesive), sealer temperature, film properties, etc. FIG. 1A shows only one of the possible arrangements of spreader 22 and sealer 24 contact ranges.

Spreaders 22 and sealers 24 may be moved laterally, vertically, pivotally, or some combination, into and out of place, by suitable motors, drives, etc. For example, the spreaders and sealers may be mounted on a rotating device that places the elements in the upstream position, drives them in direction D, removes them in the downstream position, and then returns them to the upstream position. A programmable logic controller, motors and sensors can be used to control such movement as desired. Various guide rollers 34, which may be driven or idlers, may be provided to guide the films thorough line 10*a*. The films may be paid off rolls 12, 14, 16 at different speeds to account for the different lengths of films used in forming zone 20. That is, more of films 26 and 30 is needed than of film 28, as configured in FIG. 1A. Some or all of the film supply rolls 12, 14, 16 may therefore be driven, and other flow controlling structures such as gimballing rollers or the like may be used.

Perforating devices 36, 38, and 40, schematically shown in FIG. 1A, may also be employed, if desired. As shown, perforating device 36 perforates all three films 26, 28, 30, so as to allow for division of the films into separate holders. Perforating device 38 perforates film 26, and perforating device 40 perforates film 30. These latter perforations allow individual articles to be removed from the formed holders later. Perforating devices 36, 38, 40 may be linearly or rotationally moving knife devices. Controllers and servomotors and the like may cause the perforating devices to operate at desired times, to achieve perforations where desired in the films.

Figure 1B:
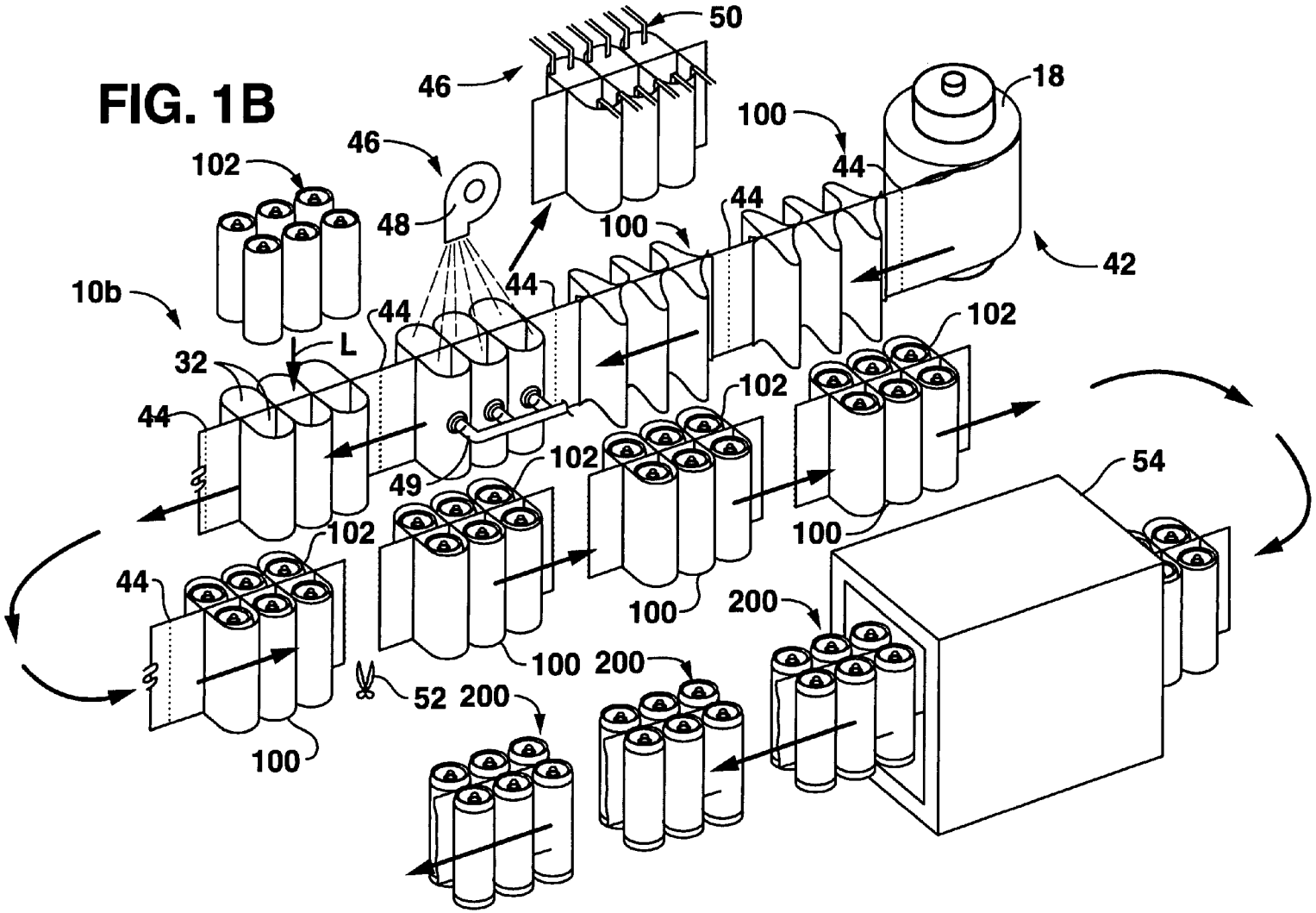
FIG. 1B is a perspective schematic view of one possible line configuration of a line for placing articles in heat-shrinkable holders so as to create a package.

Take up roll 18 may be eliminated if desired, and line 10*a* of FIG. 1A may lead directly to line 10*b* of FIG. 1B. Alternatively, take up roll 18 may be replaced by a box or the like, with the film material being fan folded in place. Use of a box may provide easier splicing and changeout opportunities, while use of a roll may provide more secure control and denser packaging. Either is an acceptable modification of that shown.

FIG. 1B is a perspective schematic view of one possible line configuration of a line 10*b* for placing articles in heat-shrinkable holders so as to create a package. As stated, lines 10*a* and 10*b* may be merged into one line, eliminating the need for use of take up rolls 18, if desired. As shown, roll 18 supplies blank 42 material, comprising in FIG. 1B adjacent six-pack holders 100 separated by perforations 44 formed by device 36. Blank 42 travels to an opening station 46, where an opener such as a blower 48, a suction device 49, or a mechanical finger device 50, or some combination of both opens the openings 32 of holders 100. Articles 102 are then loaded into openings 32 (see arrow L). As shown, six cans are vertically moved into the openings 32. However, the articles may instead be vertically stationary and the blank material may be placed over the articles from above or below, if desired. Blank 42 is then separated at perforations 44 by a divider 52 to form individual loaded holders. It is possible to not make the perforations where illustrated in line 10*a*, and to simply cut the blank 42 when indicated in line 10*b*. The loaded holders 100 are then passed into a heating device 54 such as a heat tunnel. Any of the films within the holders 100 that are heat-shrinkable will then contract, forming unitary packages 200.

If desired, packages 200 may be further combined in various ways, such as by heat sealing or shrinking or adhesives to create still larger packages. For example, two six packs could be combined to create a twelve pack (see FIG. 5B); four six packs could be combined to create a case, etc. Also, packages 200 may be connected vertically.

It should be understood that the representations of FIGS. 1A and 1B are not intended to be to scale and are schematic illustrations only. It should also be understood that the line 10*a* need not use three films; any number of films greater than two may be employed with modification of the line. For example, two films could be used to create a linear collection of articles. Four or five films could be used to create a grouping of articles three across (as opposed to two across). Modifications to the heat sealing and possible use of adhesives, whether heat activated, heat cured, contact adhesives, or otherwise, could be used to create larger arrays of openings and larger packages.

Figure 2B:
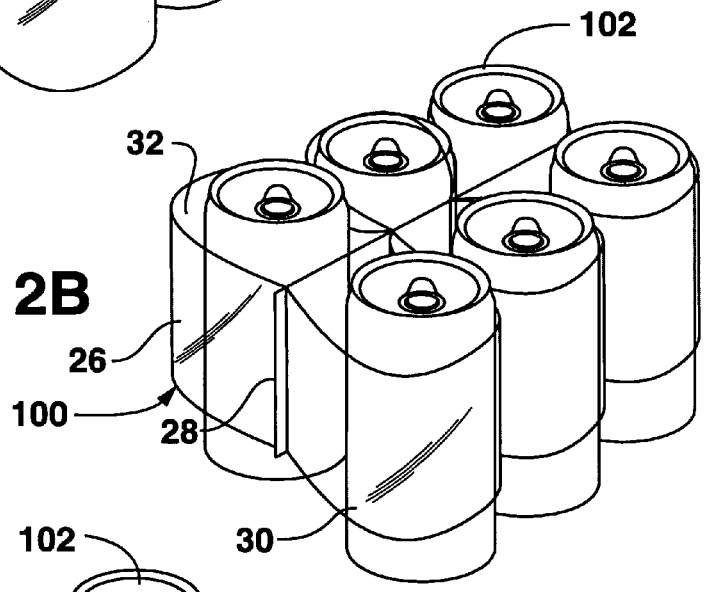
FIG. 2B is a perspective view of the heat shrinkable holder as in FIG. 2A, with articles located within the openings of the holder, before heat-shrinking.
Figure 2C:
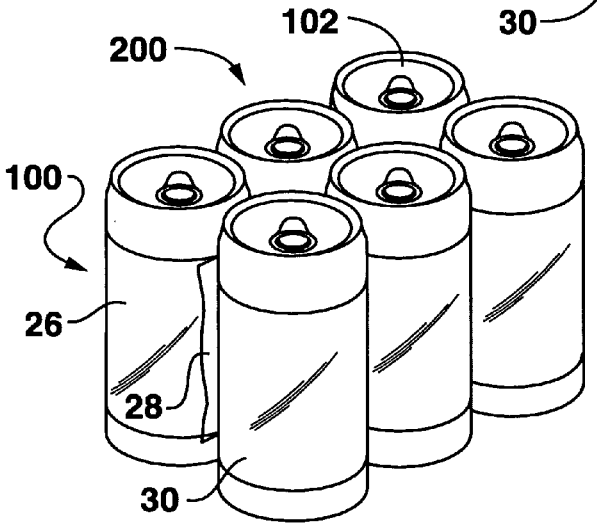
FIG. 2C is a perspective view of the holder and articles as in FIG. 2B, after heat-shrinking.

FIGS. 2A-2C show enlarged views of a holder 100 and articles 102, in this case cans. FIG. 2A shows a holder 100, as separated along perforations 44. It would be possible to separate the holders 100 before filling them with articles 102, if desired. FIG. 2B shows six articles 102 in openings 32 of holder 100 before heat shrinking. FIG. 2C shows unitized package 200 after heat shrinking. FIGS. 2B and 2C illustrate that heat-shrinking can beneficially cause the articles 102 to be pulled together in two perpendicular dimensions, that is along the line of central film 28 and perpendicular to it. This shrinking helps ensure a solid unitized package 200. Adjacent articles 102 all have film between their sides to the will not "clank" into each other, possibly damaging the articles during handling or shipping. This is especially useful if the articles are containers, such as glass bottles. Also, the heat shrinking maintains the articles in a solid formation, as opposed to certain container holders where the bottoms of the containers may swing out from the tops when moved about. Again, the disclosed holder 100 prevents such swinging, and potentially prevents damage resulting therefrom. Articles are unlikely to slip out of holder 100 due to the tensions caused by heat shrinking, making them easy to handle and carry. Also, the resulting unitary package can be readily stacked and or used in displays. Because each article is packaged in its own heat-shrunken opening, individual containers are readily removed without damaging the integrity of the rest of the package.

Figure 3:
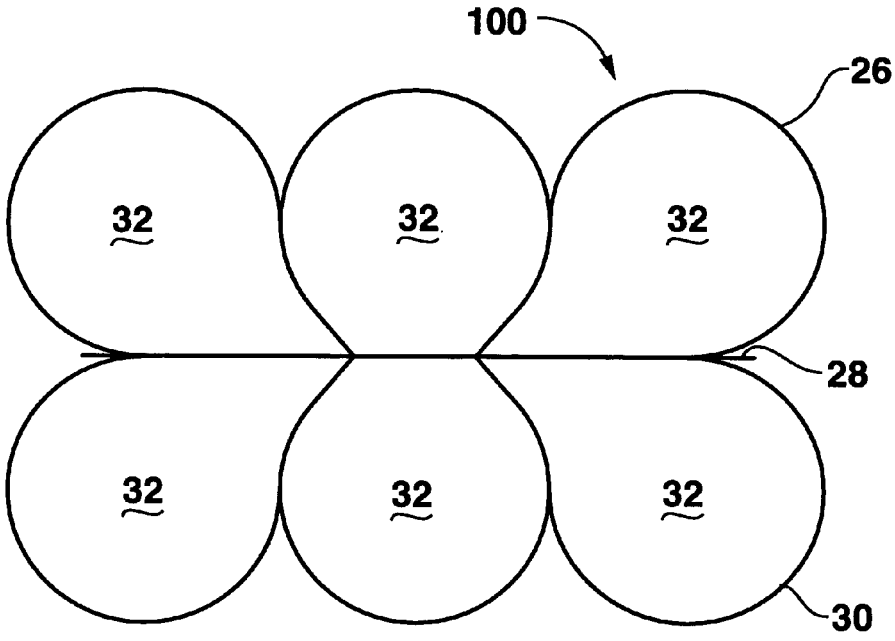
FIG. 3 is a top view of a heat-shrunken holder as in FIG. 2C, with the articles removed for clarity.

FIG. 3 is a top view of a heat-shrunken holder 100 as in FIG. 2C, with the articles removed for clarity. As seen, shrinking along the central line followed by film 28 helps draw the six containers in to form a unitized shape, with all adjacent containers having at least one buffering piece of film between them for protection. As can be seen, the amount of film used from films 26 and 30 is much greater than from central film 28, and the outermost openings 32 are larger than the central openings. Based on the size and shape of the articles to be packaged, the operation of forming zone 20 can be readily designed so as to achieve a desired resulting configuration. The amount of film used for outer films 26 and 30 may thus be two times more than that of film 28, and could be as much as four or more times greater as well, depending on the application.

Figure 4A:
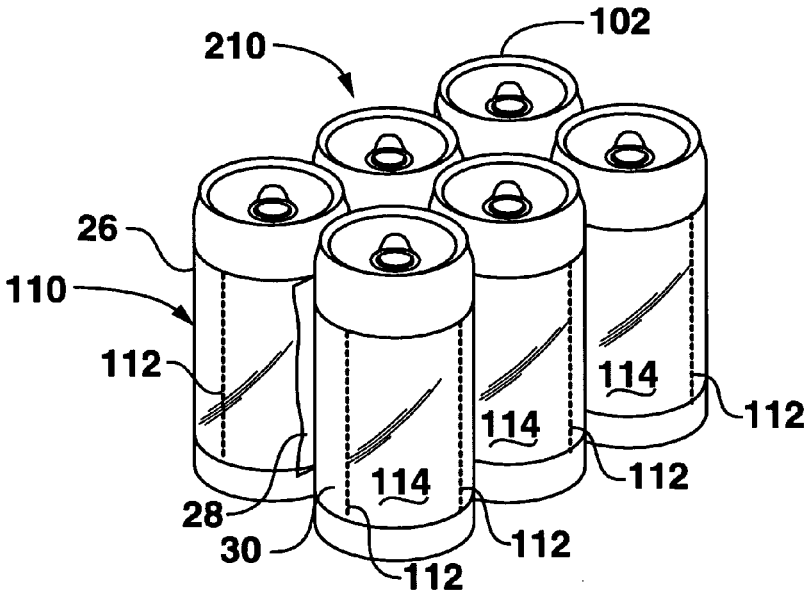
FIG. 4A is a perspective view of an alternate heat-shrunken holder and articles, as in FIG. 2C, wherein the holder includes perforations for assisting in removing individual articles.

FIG. 4A is a perspective view of an alternate package 210 including heat-shrunken holder 110 and articles 102, as in FIG. 2C, wherein the holder includes additional perforations 112 for assisting in removing the individual articles. Perforations 112 are made by devices 38 and 40 in line 10*a*, as discussed above. As shown, two perforations 112 are provided for each article 102, but more or fewer may be provided. Also, the area of film 114 between the perforations may be bonded to the article 102, if desired, for example, by an adhesive that could be applied to the film or article, or activated during heat shrinking or otherwise. Thus, the holder 100 would provide a label for the article 102 via film piece 114, eliminating the necessity of separately labeling the article. (See FIG. 4E below for printed indicia on film).

Figure 4B:
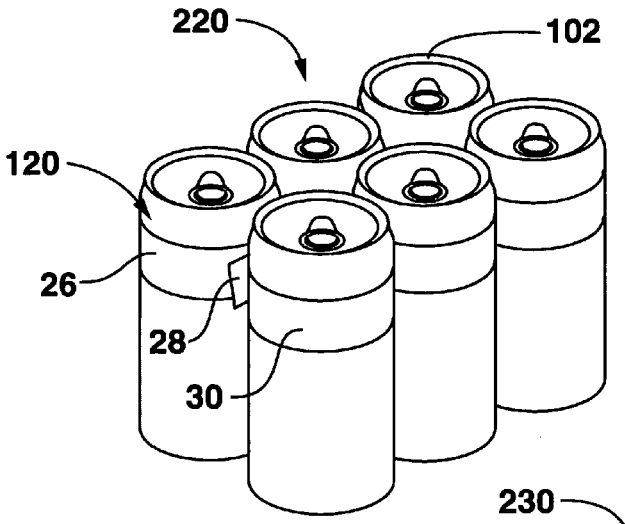
FIG. 4B is a perspective view of an alternate heat-shrunken holder and articles, as in FIG. 2C, wherein the holder has a smaller vertical dimension.

FIG. 4B is a perspective view of an alternate heat-shrunken package 220 including holder 120 and articles 102, as in FIG. 2C, wherein the holder has a smaller vertical dimension. If desired, holder 120 may thus cover less of the articles, but the protective abilities may be lessened at some point with a smaller holder. Also, the holder may be placed around a bottle neck or along a can ridge, if desired.

Figure 4C:
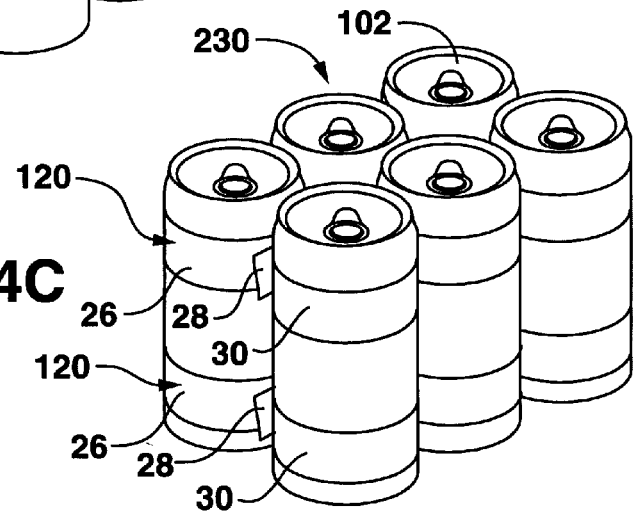
FIG. 4C is a perspective view of an alternate heat-shrunken holder and articles, as in FIG. 2C, wherein the articles are held by two holders as in FIG. 4B.

FIG. 4C is a perspective view of an alternate heat-shrunken package 230 including holder 120 and articles 102, as in FIG. 2C, wherein the articles are held by two holders 120 as in FIG. 4B. Use of two smaller holders 120 requires less film than holder 100 and addresses protection issues noted above, although assembly of the package 230 may be more complex.

Figure 4D:
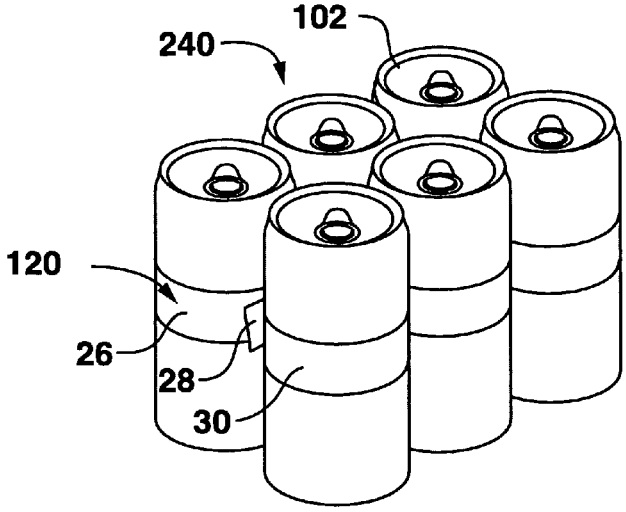
FIG. 4D is a perspective view of an alternate heat-shrunken holder and articles, as in FIG. 2C, wherein the holder is smaller and centrally located vertically along the articles.

FIG. 4D is a perspective view of another alternate package 240 including a heat-shrunken holder 120 and articles 102, as in FIG. 2C, wherein the holder is smaller and centrally located vertically along the articles. Central location of a smaller holder may also address protection issues while reducing material used.

Figure 4E:
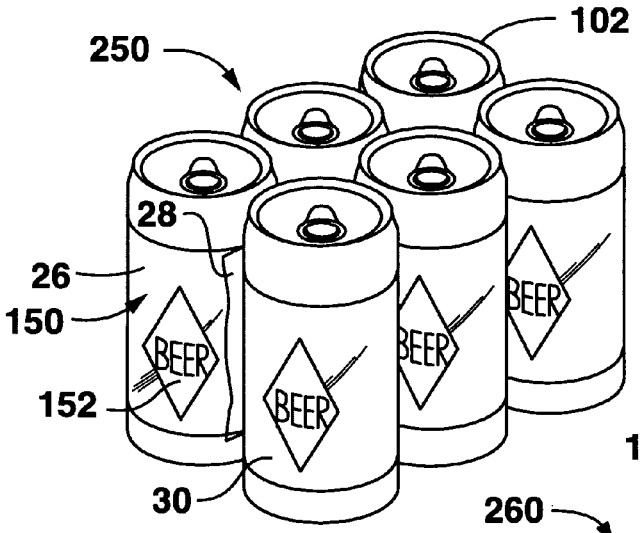
FIG. 4E is a perspective view of an alternate heat-shrunken holder and articles, as in FIG. 2C, wherein the holder includes printed indicia thereon.

FIG. 4E is a perspective view of an alternate package 250 including a heat-shrunken holder 150 and articles 102, as in FIG. 2C, wherein the holder 150 includes printed indicia 152 thereon. The printed indicia 152 may be individual elements or a common element across the various articles or across multiple packages, as desired. Thus all article labeling or supplemental article labeling may be accomplished via the package holder portion.

Figure 4F:
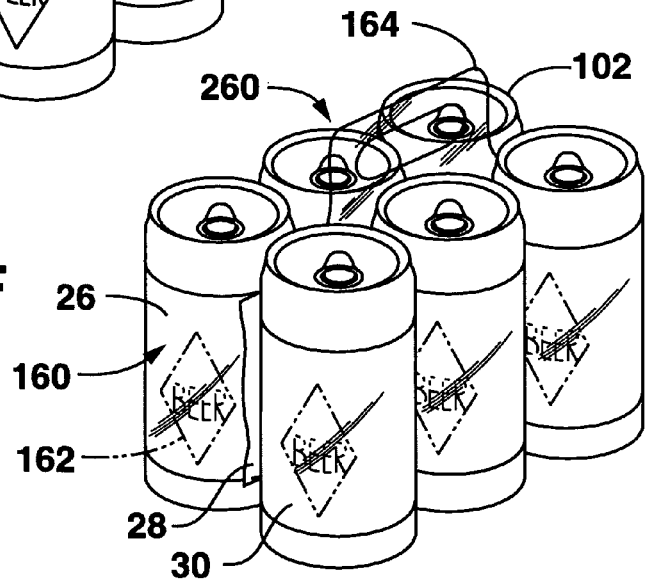
FIG. 4F is a perspective view of an alternate heat-shrunken holder and articles, as in FIG. 2C, wherein printed indicia on the articles may be seen through at least a portion of the holder, and including an optional handle.

FIG. 4F is a perspective view of an alternate package 260 including a heat-shrunken holder 160 and articles 102, as in FIG. 2C, wherein printed indicia 162 on the articles 102 may be seen through at least a portion of the holder, and including an optional handle 164. In this embodiment, the outer films 26 and 30 would be at least partially translucent or transparent in whole or part. If such a handle 164 were provided, it could be part of a film, such as central film 28 as shown, or an entirely separate piece attached in some way, such as via heat or adhesive. Handle 164 could need to be made of a more robust and/or less or non-shrinkable film or other material, depending on the size and weight of the package.

Figure 4G:
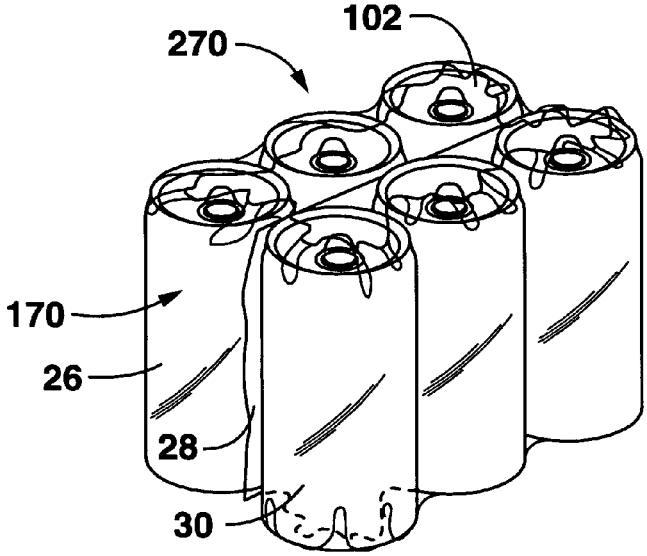
FIG. 4G is a perspective view of an alternate heat-shrunken holder and articles, as in FIG. 2C, wherein the holder extends along the entire side surfaces and at least partially onto the top and bottom surfaces of the articles.

FIG. 4G is a perspective view of an alternate package 270 including heat-shrunken holder 170 and articles 102, as in FIG. 2C, wherein the holder extends along the entire side surfaces and at least partially onto the top and bottom surfaces of the articles. Thus, as shown, the articles 102 are substantially wrapped and secured in three dimensions using holder 170.

Figure 5A:
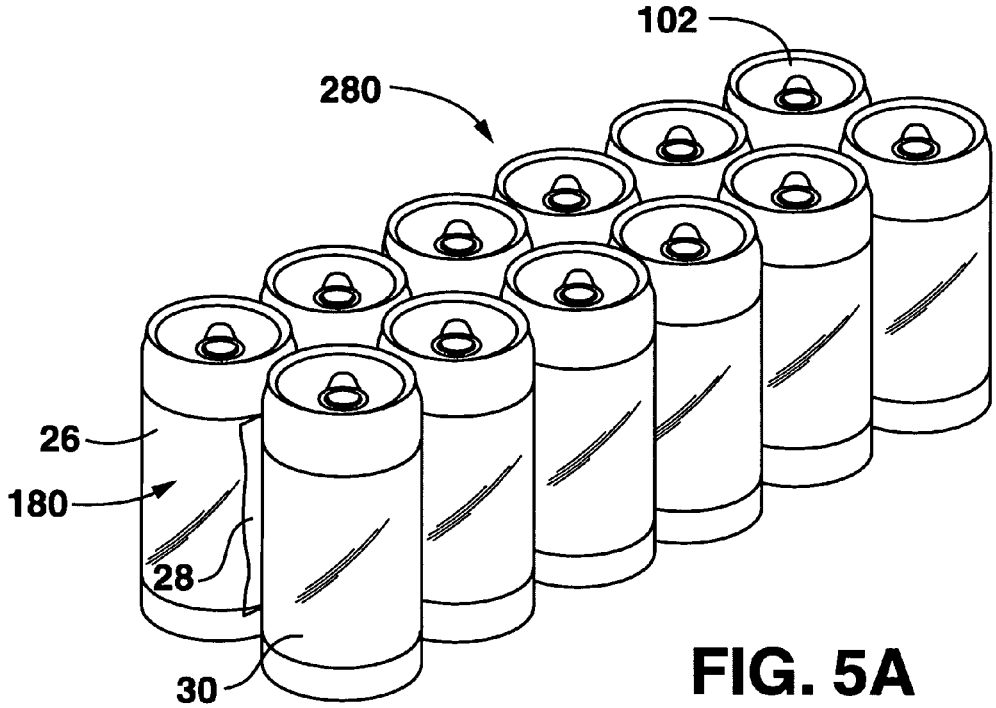
FIG. 5A is a perspective view of an alternate heat-shrunken holder and articles, as in FIG. 2C, wherein the holder holds more articles in a two by six arrangement.
Figure 5B:
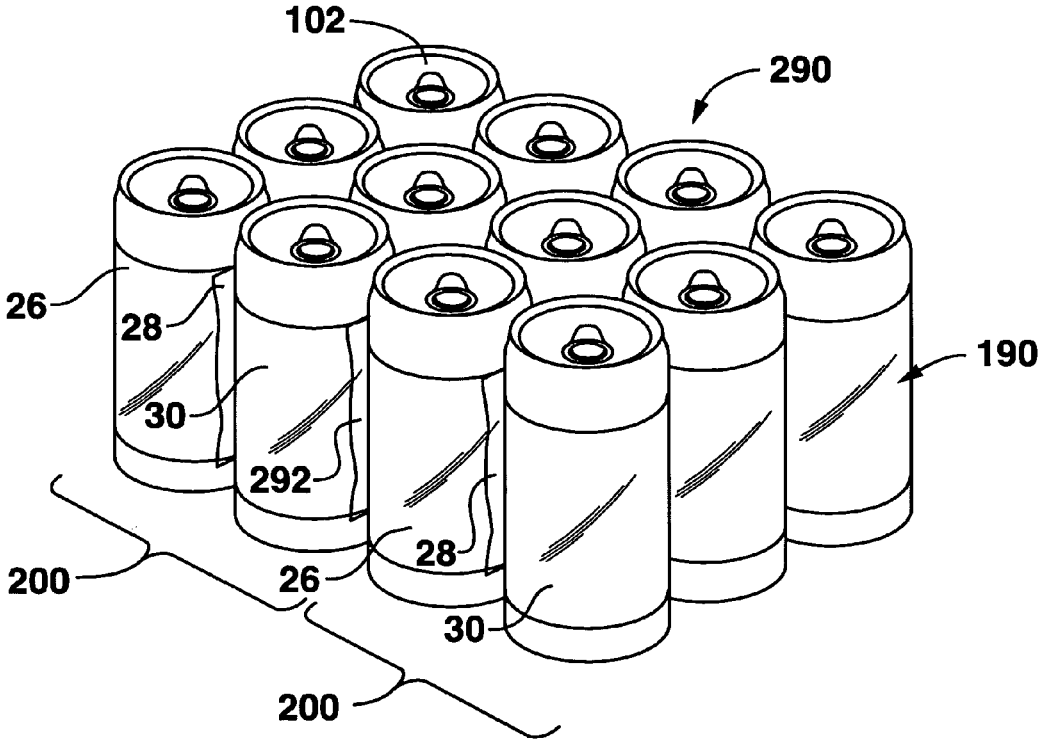
FIG. 5B is a perspective view of an alternate heat-shrunken holder and articles, as in FIG. 2C, wherein the holder holds more articles in a three by four arrangement.

FIG. 5A is a perspective view of an alternate package 280 including a heat-shrunken holder 180 and articles 102, wherein the holder holds articles in a two by six arrangement. Thus, it should be understood that various arrangements of articles is possible. For example, as further shown in FIG. 5B alternate package 290 includes a heat-shrunken holder 190 and articles 102, wherein the holder holds articles in a three by four, twelve-pack arrangement. Such arrangement can be achieved in various ways, and in various steps as mentioned above. As shown herein, the package 290 is essentially equivalent to two side-by-side six pack packages 200, with an added film layer 292 therebetween. Layer 292 could be applied via heat and/or adhesive. Alternatively, the entire twelve article holder 190 could be constructed in one pass on a modified version of line 10*a*.

Figure 6A:
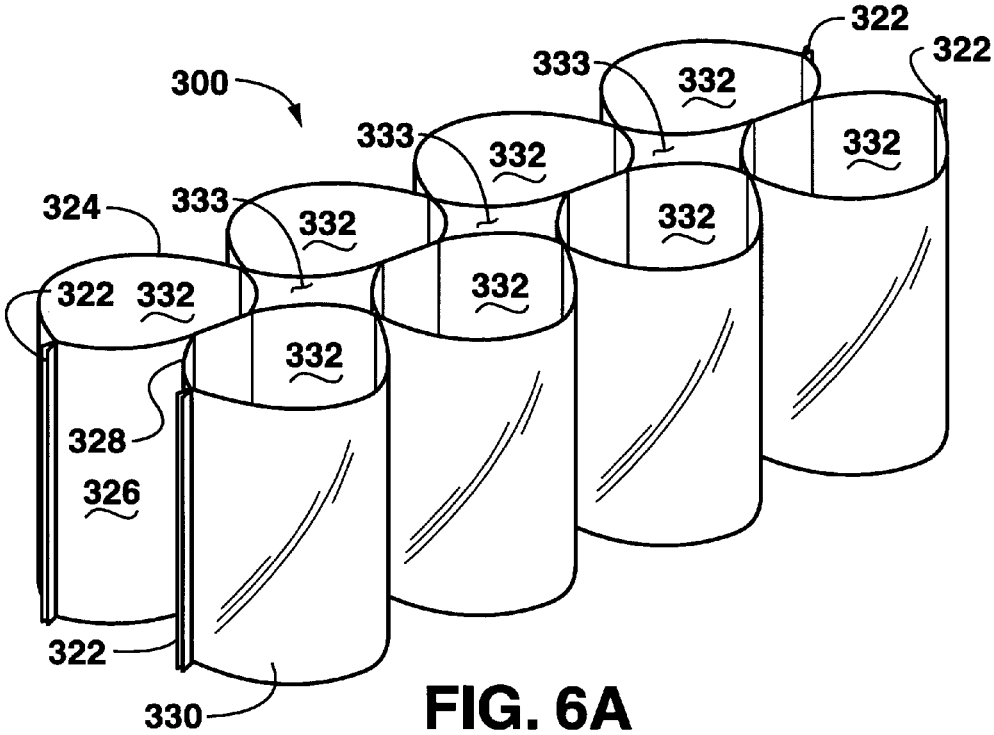
FIG. 6A is a perspective view of an alternate empty heat-shrinkable holder.
Figure 6B:
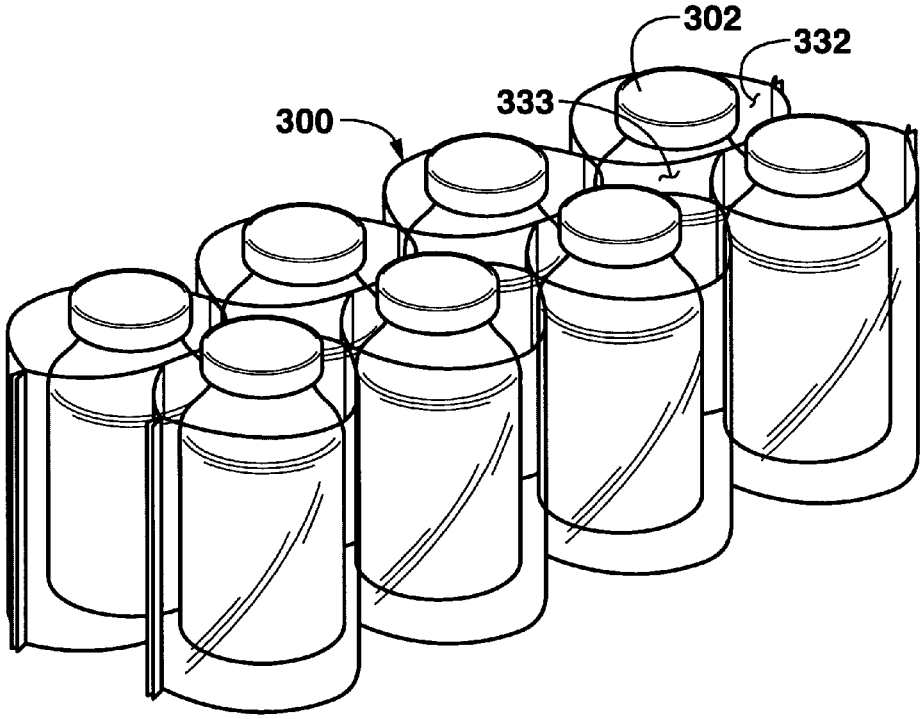
FIG. 6B is a perspective view of the heat shrinkable holder as in FIG. 6A, with articles located within the openings of the holder, before heat-shrinking.
Figure 6C:
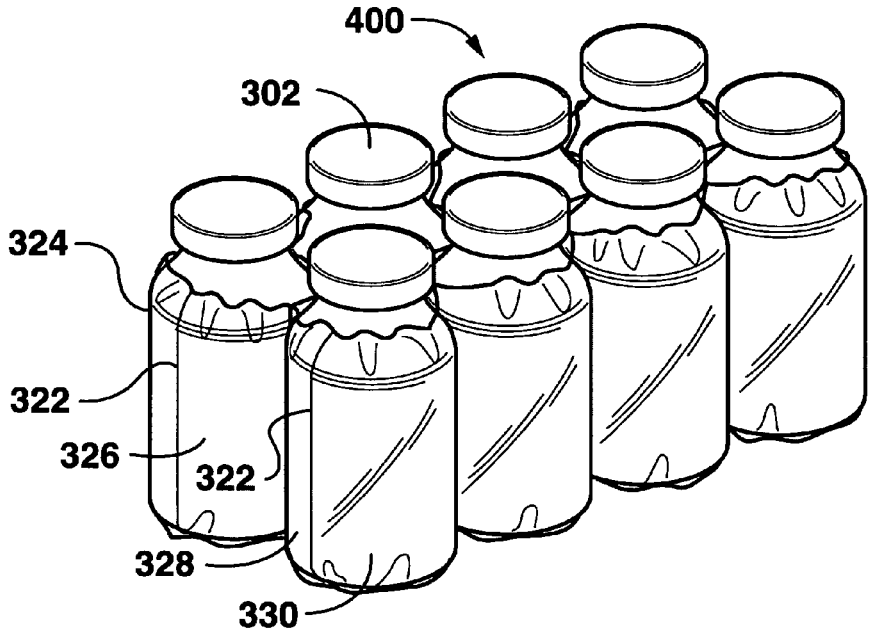
FIG. 6C is a perspective view of the holder and articles as in FIG. 6B, after heat-shrinking.

FIGS. 6A-6C show enlarged views of an alternate holder 300 and articles 302, in this case bottles. Holder 300 is made from four sheets of film, 324, 326, 328, 330. Holder 300 may be formed from a blank holding a plurality of such holders, separable along perforations, such as perforations 44 discussed above. Separation of holders 300 results in two edges 322 at each end of the holder. As shown, holder 300 has eight openings 332 for receiving the articles 302, although as discussed above, practically any number could be employed. Other openings 333 are created by the manufacturing process, but these are not necessarily sized to accept articles 302, or at least articles of the same size. FIG. 6B shows eight articles 302 in openings 332 of holder 300 before heat shrinking. FIG. 6C shows unitized package 400 after heat shrinking. As with FIGS. 2B and 2C above, heat-shrinking can cause the articles 302 to be pulled together in two perpendicular dimensions, helping ensure a solid unitized package 400. Adjacent articles 302 all have film between their sides, as above, and each article is again packaged in its own heat-shrunken opening so that individual containers are readily removed without damaging the integrity of the rest of the package.

Holder 300 beneficially includes sheets of substantially equal length between edges 322. Such equal sheet length allows holder 300 or a blank of multiple holders to lie flat or be readily rolled. In some applications, such abilities may be desirable, as compared to the holders described above.

It should be understood that although holder 300 is illustrated as having four sheets and eight openings, various different sizes are possible. For example, holder 300 could have two sheets holding a linear grouping of articles, or could have six or eight sheets, holding wider groupings.

Figure 7:
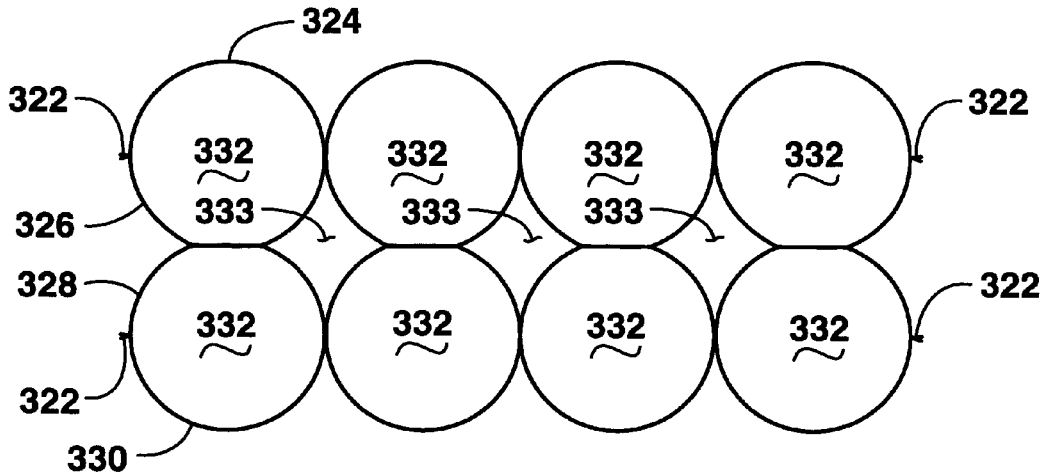
FIG. 7 is a top view of a heat-shrunken holder as in FIG. 6C, with the articles removed for clarity.

FIG. 7 is a top view of a section through heat-shrunken holder 300, with the articles removed for clarity. As seen, shrinking helps draw the eight containers in to form a unitized shape, with all adjacent containers having at least one buffering piece of film between them for protection. Since the amount of film used from films 324-330 is somewhat equal, the resulting package is somewhat symmetrical.

Based on the size and shape of the articles to be packaged, the operation of forming zone as shown in FIG. 1A and the filling zone in FIG. 1B can be readily modified to form holder 300. For example, an even number of film supply rolls could be used, and the spreaders and sealers could be arranged as needed to form the desired configuration. It would be possible to first join two films to form an initial blank having one row of openings for articles, and then to join two or more of those blanks so as to create a package having more than one row. It would also be possible to join the films using a heat sealer while joining the blanks using an adhesive, or vice versa. The ultimate processes and machinery will depend on the desired package shape.

Figure 8A:
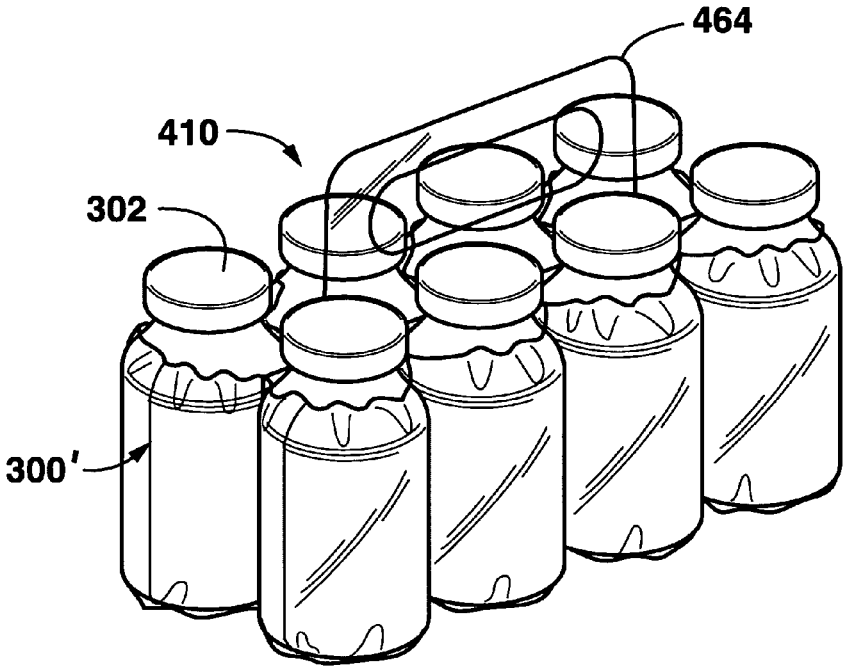
FIG. 8A is a perspective view of an alternate heat-shrunken holder and articles, wherein the holder includes an optional handle.
Figure 8B:
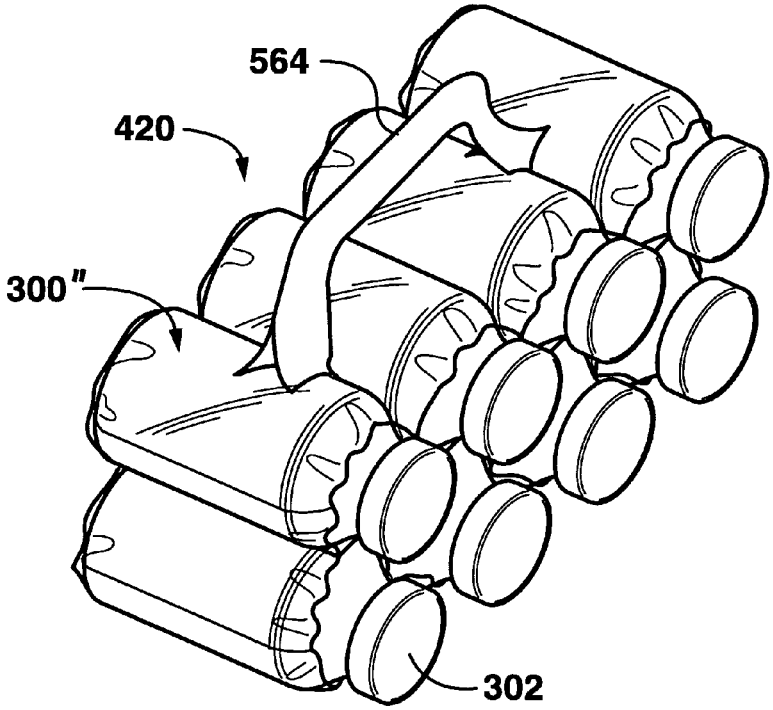
FIG. 8B is a perspective view of an alternate heat-shrunken holder and articles, wherein the holder includes an alternate optional handle.

FIGS. 8A and 8B show two modifications to package 400 including handles. In FIG. 8A, package 410 includes a handle 464, similar to that shown above. Handle 464 may extend from one of the sheets forming holder 300' or may be an added sheet. In FIG. 8B, handle 564 of package 420 is attached to an outer sheet of holder 300". Handle 564 may be attached at any location via heat sealing or adhesive. Either handle may be made of shirnkable or nonshrinkable plastic or other materials, as desired. Handle 564 may also extend further around package for a more secure hold, if desired.

Various types of films may be used for the holders' films and handles, such as commercially available heat-shrink films, such as polyethylene (LLDPE, LDPE, HDPE), PVC, polypropylene, styrene copolymer, or the like. The ultimate material selected and its properties can be selected to achieve the needs of the size, shape, weight, and number of the articles being packaged, the method of shipment, sale and use, etc.

Therefore, it should be understood that the types of holders, packages, and articles utilized with the teachings of the present disclosure should not be limited to those embodiments shown herein. It should also be understood that features of the various embodiments above may be recombined in other ways to achieve still further embodiments within the scope of the present invention.

What is claimed is:

1. A method of packaging articles comprising:

providing two of a first sheet of heat-shrinkable material, each first sheet defining a plurality of pre-shrinking holder lengths;

providing two of a second sheet of heat-shrinkable material, each second sheet being separate from the first sheets and defining a plurality of pre-shrinking holder lengths substantially equal to those of the first sheets;

joining the first sheets to the second sheets at discrete joinder portions spaced along the first and second sheets so as to form a plurality of openings, each opening located between each adjacent pair of joinder portions, the joinder forming a plurality of holders each having the pre-shrinking holder lengths of the first and second sheets;

inserting an article into each of the openings; and heating the first and second sheets to shrink the first and second sheets thereby forming a unitary package of the sheets and the inserted articles, the first and second sheets being sized so that during the heating step the articles are drawn together in two perpendicular directions.

2. The method of claim 1, further including cutting the first and second sheets to form an article holder of the pre-shrinking holder length before the heating step.

3. The method of claim 1, wherein the first and second sheets are joined so as to form a plurality of openings arranged in two rows.

4. The method of claim 1, further including forming perforations in at least one of the first or second sheets to allow removal of individual articles.

5. The method of claim 1, wherein the joining step is achieved by at least one of applying an adhesive or applying heat.

6. The method of claim 1, further including opening the openings before the inserting step.

7. The method of claim 6, wherein the opening step includes one of blowing a gas, applying suction, or using one or more mechanical fingers to open the openings.

8. The method of claim 1, wherein the articles are containers.

9. The method of claim 1, further including the step of providing a handle for the package.

10. A method of packaging articles comprising:

providing two of a first sheet of heat-shrinkable material, the first sheets defining a plurality of pre-shrinking holder lengths;

providing two of a second sheet of heat-shrinkable material, the second sheets being separate from the first sheets and defining a plurality of pre-shrinking holder lengths substantially equal to those of the first sheets; and joining the first sheets to the second sheets at discrete joinder portions spaced along the first and second sheets so as to form a plurality of openings, each opening located between each adjacent pair of joinder portions and configured and sized pre-shrinking for receiving an article, the joinder forming a plurality of holders each having the pre-shrinking holder lengths of the first and second sheets, the first and second sheets are sized so that the articles are drawn together in two perpendicular directions upon heating.

11. The method of claim 10, wherein each opening is located between each adjacent pair of joinder portions, the joinder forming a plurality of holders each having the pre-shrinking holder lengths of the sheets.

12. The method of claim 10, further comprising the step of providing a handle for the package.

* * * * *